US010611617B2

(12) United States Patent
Greilinger et al.

(10) Patent No.: US 10,611,617 B2
(45) Date of Patent: Apr. 7, 2020

(54) LIFTING COLUMN

(71) Applicant: Aktiebolaget SKF, Gothenburg (SE)

(72) Inventors: Daniel Greilinger, Rothenfluh (CH); Marcel Soltermann, Sankt Pantaleon (CH)

(73) Assignee: Aktiebolaget SKF, Goeteborg (SE)

( * ) Notice: Subject to any disclaimer, the term of this patent is extended or adjusted under 35 U.S.C. 154(b) by 237 days.

(21) Appl. No.: 15/795,686

(22) Filed: Oct. 27, 2017

(65) Prior Publication Data

US 2018/0118545 A1 May 3, 2018

(30) Foreign Application Priority Data

Oct. 28, 2016 (DE) ..... 10 2016 221 286

(51) Int. Cl.
*B66F 17/00* (2006.01)
*B66F 7/28* (2006.01)
*B66F 3/10* (2006.01)

(52) U.S. Cl.
CPC ..... *B66F 17/00* (2013.01); *B66F 3/10* (2013.01); *B66F 7/28* (2013.01)

(58) Field of Classification Search
CPC ..... B66F 7/28
See application file for complete search history.

(56) References Cited

U.S. PATENT DOCUMENTS 3,042,006 A * 7/1962 Butorac ..... B66F 3/24 91/20
3,888,085 A * 6/1975 Larsonneur ..... B60R 22/1955 60/635
7,185,868 B2 * 3/2007 Wang ..... A47F 5/04 248/125.1
7,458,562 B1 * 12/2008 Chen ..... B66F 3/10 254/103
7,712,389 B2 * 5/2010 Wang ..... F16H 25/20 254/102
8,001,733 B2 * 8/2011 Chen ..... E04G 25/04 52/126.4
8,495,924 B2 * 7/2013 Fukano ..... F16H 25/2454 254/98
2002/0162410 A1 * 11/2002 Zimmerman ..... A47B 9/04 74/89.35
2015/0075306 A1 * 3/2015 Castelli ..... B66F 3/10 74/89.35

* cited by examiner

*Primary Examiner* — Tyrone V Hall, Jr.
(74) *Attorney, Agent, or Firm* — Laurence A. Greenberg; Werner H. Stemer; Ralph E. Locher

(57) ABSTRACT

A lifting column includes a first column element and at least one second column element, the at least one second column element being movable relative to the first column element, and at least one damping unit. The damping unit is deformable by a force that acts on an upper side of the lifting column in at least one operating configuration of the lifting column such that the force is at least partly transmitted through the damping unit to a drive of the lifting column.

18 Claims, 2 Drawing Sheets

LIFTING COLUMN

CROSS-REFERENCE

This application claims priority to German patent application no. 10 2016 221 286.9 filed on Oct. 28, 2016, the contents of which are fully incorporated herein by reference.

TECHNOLOGICAL FIELD

The disclosure is directed to a lifting column having at least first and second telescoping elements.

BACKGROUND

A lifting column including two columns is known.

SUMMARY

An aspect of the disclosure is in particular to provide a lifting column of the above-mentioned type with a long service life. This aspect is achieved according to the disclosure.

The disclosure relates to a lifting column including a first column element and at least one second column element that are movable relative to each other.

It is disclosed that the lifting column includes at least one damping unit that is deformable by a force that acts on a top side of the lifting column in at least one operating state. As a result, a long operating life can be achieved. In particular vibrations and shock loads, which may cause a failure of the drive of the lifting column and thus limit the service life of the lifting column, are effectively damped, such that a failure of the drive does not occur.

Preferably in at least one operating state the damping unit transmits the force at least partially to a drive of the lifting column.

The lifting column advantageously includes at least one chain and/or at least one belt, and the chain and/or the belt at least partially transmits the force to the damping unit.

It is further disclosed that the lifting column includes at least one carrier element, which at least partially forms the upper side, and at least one essentially rod-shaped component that at least partially transmits the force to a drive of the lifting column, wherein the damping unit is disposed at least partially between the carrier element and the component.

The damping unit preferably includes at least one part that rests relative to a motor of the lifting column with each operation.

In addition it is disclosed that the damping unit includes at least one elastomer and/or rubber and/or at least one oil damper and/or at least one coil spring and/or at least one plate spring and/or at least one gas spring.

At least a part of the damping unit is preferably sleeve-shaped.

The lifting column advantageously includes at least one third column element, and the three column elements are movable relative to one another.

Further advantages arise from the following description of the drawings. Exemplary embodiments of the disclosure are depicted in the drawings. The drawings, the description, and the claims contain numerous features in combination. The person skilled in the art will also advantageously consider the features individually and in further meaningful combinations.

DETAILED DESCRIPTION

Figure 1:
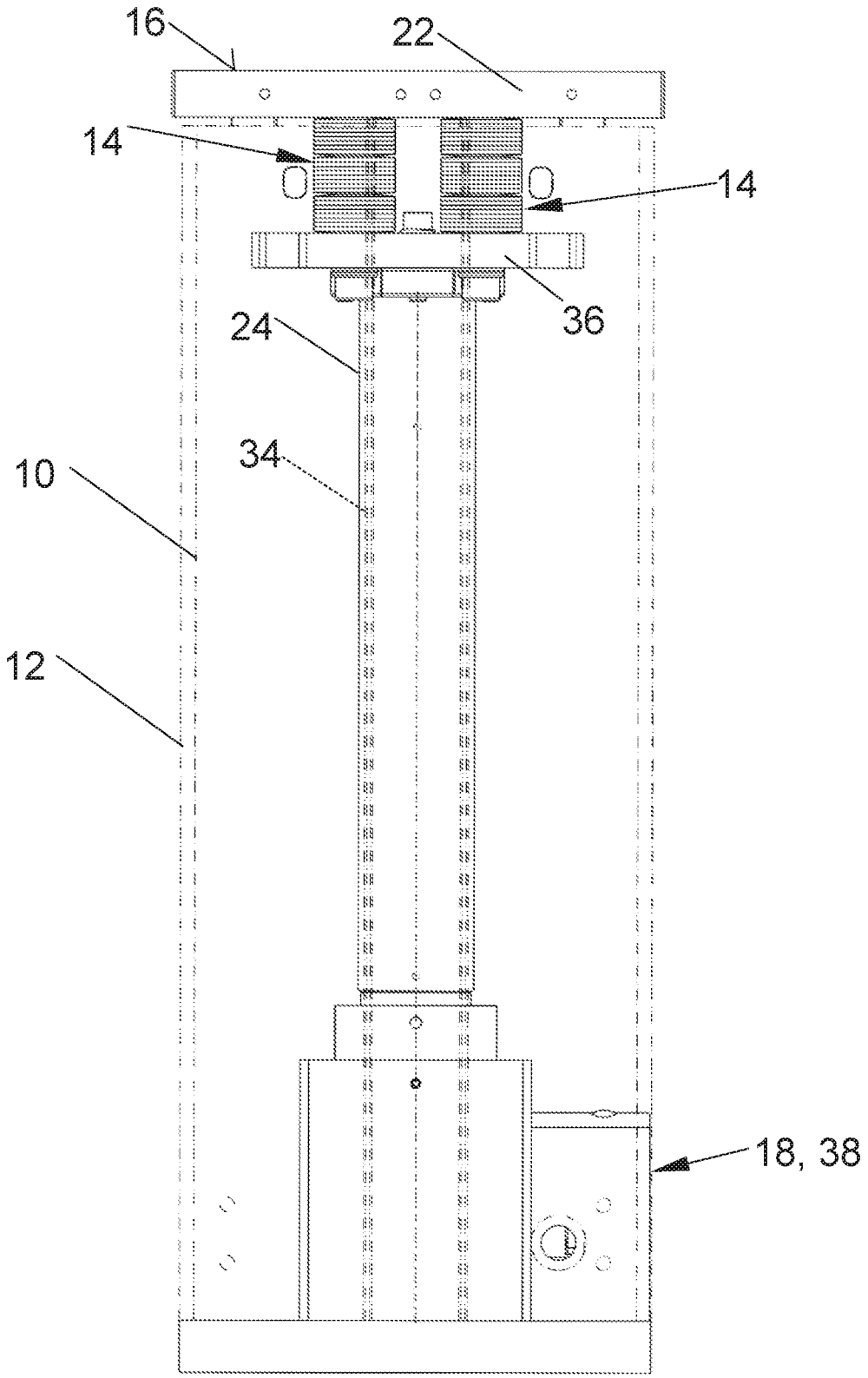
FIG. 1 is a side view of a lifting column according to the disclosure in which two column elements of the lifting column are shown as being transparent for illustration purposes.

FIG. 1 shows a side view of an inventive lifting column, which includes two column elements 10, 12. The first lifting column 10 is displaceable into the second lifting column 12 and out therefrom using a motor (not shown), wherein the two lifting columns perform a rectilinear relative movement here. Both lifting columns are configured essentially tubular. In an operating position both column elements 10, 12 are disposed such that their longitudinal direction is parallel to the vertical direction. A basic position of the lifting column is depicted in FIG. 1. Starting from this position the first column element 10 was moved upward in the vertical direction relative to the second column element 12, wherein the second column element 12 remains at rest relative to a floor on which it is disposed. The lifting column includes a carrier element 22 that is attached to the first column element 10. The lifting column further comprises a threaded spindle 34 and a component 24 that is configured as a threaded nut. A carrier plate 36 is attached to the component 24. A damping unit is attached to the carrier plate 36 and to the carrier element 22, which damping unit is deformable by a force that acts on an upper side 16 of the lifting column in an operating state. The upper side 16 is simultaneously an upper side of the carrier plate 22. When the force acts on the upper side 16 of the carrier unit 22, the damping unit 14 is compressed in the vertical direction. In the present exemplary embodiment the damping unit is comprised of plate-spring packets. The damping unit is partially disposed between the component 24 and the carrier element 22. A center of gravity of the threaded spindle is always at rest relative to the two column elements. In order to generate a relative movement between the column elements, the motor sets the threaded spindle 34 in rotation, which causes the threaded nut 24 that is attached to the carrier plate 36 to perform a rectilinear movement relative to the second column element in a vertical direction upward or downward. Here a center of gravity of the threaded spindle 34 remains at rest relative to the second column element 12. When the force acts on the upper side of the carrier plate 22, the damping unit transfers it to the threaded spindle 34, which is part of a drive 18 of the lifting column.

The motor is part of the drive 18. It is alternatively conceivable that the motor is not disposed inside the lifting column but rather is connectable to the drive of the threaded spindle 34 by an interface.

Figure 2:
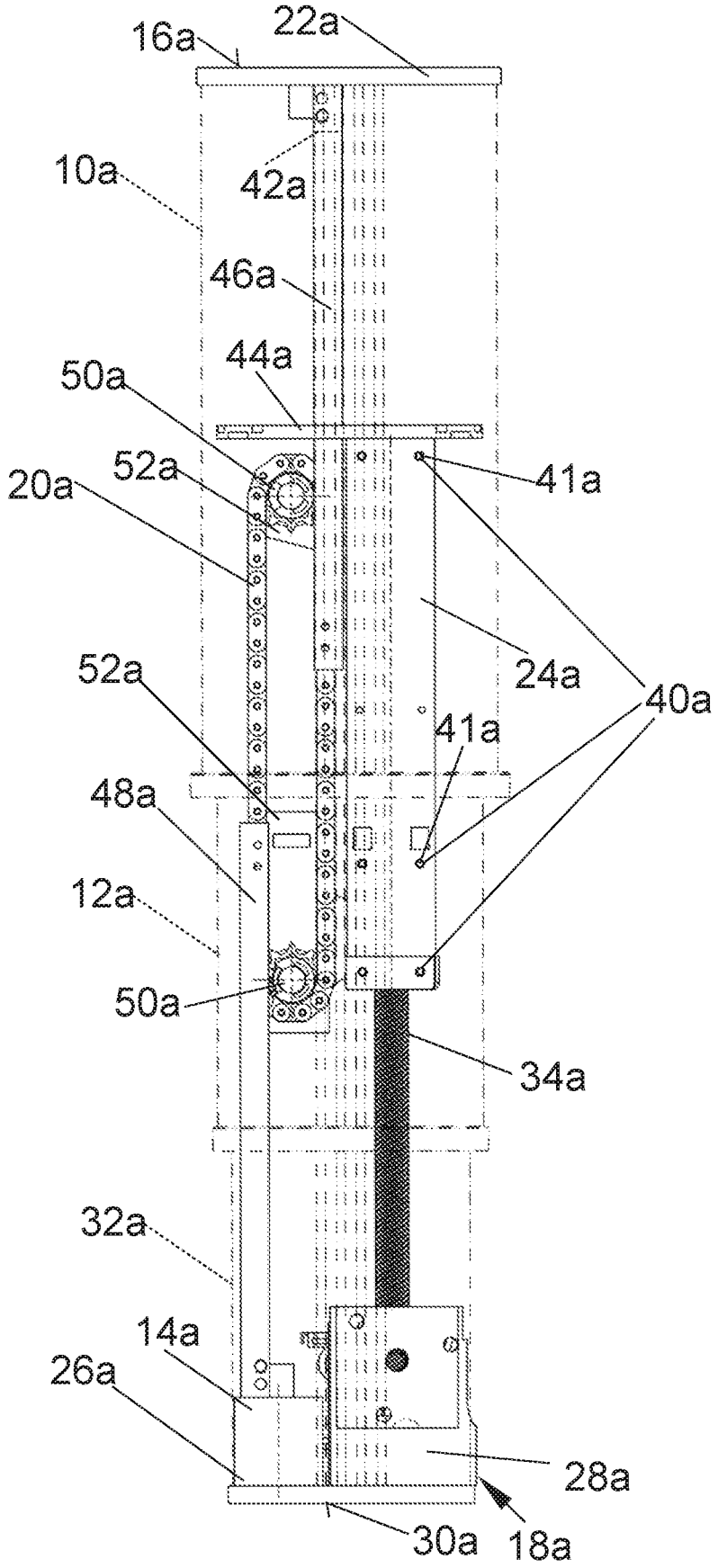
FIG. 2 is a side view of an alternative exemplary embodiment of a lifting column according to the disclosure, which includes three column elements that are shown as being transparent for illustration purposes.

In FIG. 2 an alternative exemplary embodiment is depicted. Components, features, and functions remaining essentially identical are generally numbered with the same reference numbers. However, to distinguish the exemplary embodiments, the letter "a" is added to the reference numbers of the exemplary embodiment in FIG. 2. The following description is essentially limited to the differences between the exemplary embodiments in FIG. 1 and FIG. 2, wherein with respect to components, features, and functions remaining the same, reference can be made to the description of the exemplary embodiment in FIG. 1.

FIG. 2 shows a side view of an alternative exemplary embodiment of an inventive lifting column, which is depicted as partially transparent. The lifting column includes three column elements 10*a*, 12*a*, 32*a*, which are displaceable into one another and out from one another using a drive 18*a* that includes a motor 28*a*. The column elements 10*a*, 12*a*, 32 are configured essentially tubular. Furthermore in a basic state of the lifting column, wherein it has a minimum height, the third column element 32*a* is disposed in the second column element 12*a*, and the second column element 12*a* is disposed in the first column element 10*a*. A carrier element 22*a* is attached to the column element 10*a* on its upper side. A rod 46*a* is attached to the carrier element 22*a* on its underside, which rod 46*a* protrudes through a hole in a plate 44*a* of the lifting column, which plate 44*a* is attached to the column element 12*a*. The rod 46*a* is attached to a link of a chain 20*a* of the lifting column. The lifting column further includes two pinions 50*a* around which the chain 20*a* extends. Teeth of the pinions 50*a* engage the chain 20*a*. Each of the pinions 50*a* is respectively rotatably supported on a plate 52*a*. Each of the plates 52*a* is attached, using bolts 41*a*, that are surrounded by a damping unit 40*a*, which is formed from sleeves made of rubber, to a component 24*a* of the lifting column, which is configured as a threaded nut. A force that acts on an upper side 16*a* of the carrier element 22*a* is transmitted by the rod 46*a*, the chain 20*a*, the pinions 50*a*, and the bolts 41*a* to the damping unit 40*a*. The threaded nut is movable by a threaded spindle 34*a*. In addition the threaded spindle 34*a* is drivable by a motor 28*a* that is attached to the column element 32*a*, wherein a center of gravity of the threaded spindle 34*a* is always at rest relative to the column element 32*a*. A rod 42*a* is attached to a further link of the chain 20*a* and to a damping unit 14*a*. In addition the force acting on the upper side 16*a* of the carrier element 22*a* is relayed by the two rods 46*a*, the pinions 50*a*, and the chain 20*a* to the damping unit 14*a*, which is formed by a rubber block. The damping unit 14*a* includes a part 26*a* that remains at rest relative to the motor and an underside 30*a* of the lifting column with each operation and also while the force is transmitted to the damping unit 14*a*.

Alternatively or additionally the lifting column can include a damping unit 42*a*, which is disposed between the rod 46*a* and the carrier element 22*a*.

In alternative exemplary embodiments each of the damping units that are mentioned in the above exemplary embodiment are present individually and without the other two damping units. In further alternative exemplary embodiments each of these damping units can be present with a further of the three mentioned damping units 14*a*, 40*a*, 42*a* or all three damping units can also be installed simultaneously.

Representative, non-limiting examples of the present invention were described above in detail with reference to the attached drawings. This detailed description is merely intended to teach a person of skill in the art further details for practicing preferred aspects of the present teachings and is not intended to limit the scope of the invention. Furthermore, each of the additional features and teachings disclosed above may be utilized separately or in conjunction with other features and teachings to provide improved lifting columns.

Moreover, combinations of features and steps disclosed in the above detailed description may not be necessary to practice the invention in the broadest sense, and are instead taught merely to particularly describe representative examples of the invention. Furthermore, various features of the above-described representative examples, as well as the various independent and dependent claims below, may be combined in ways that are not specifically and explicitly enumerated in order to provide additional useful embodiments of the present teachings.

All features disclosed in the description and/or the claims are intended to be disclosed separately and independently from each other for the purpose of original written disclosure, as well as for the purpose of restricting the claimed subject matter, independent of the compositions of the features in the embodiments and/or the claims. In addition, all value ranges or indications of groups of entities are intended to disclose every possible intermediate value or intermediate entity for the purpose of original written disclosure, as well as for the purpose of restricting the claimed subject matter.

REFERENCE NUMBER LIST

10 Column element
12 Column element
14 Damping unit
16 Upper side
18 Drive
20 Chain
22 Carrier element
24 Component
26 Part
28 Motor
30 Underside
32 Column element
34 Threaded spindle
36 Carrier plate
38 Interface
40 Damping unit
42 Damping unit
44 Plate
46 Rod
48 Rod
50 Pinion
52 Plate

What is claimed is:

1. A lifting column comprising:

a first column element; and at least one second column element, the at least one second column element being movable relative to the first column element, and at least one damping unit, the damping unit being deformable by a force that acts on an upper side of the lifting column in at least one operating configuration of the lifting column;

in the at least one operating configuration, the damping unit transmitting at least part of the force to a drive train of the lifting column.

2. The lifting column according to claim 1, wherein the lifting column includes at least one drive chain and/or at least one drive belt, and wherein the drive chain and/or the drive belt transmits at least part of the force to the damping unit.

3. The lifting column according to claim 1, further including at least one carrier element at an upper side of the at least one second column element and at least one rod-shaped component that transmits at least part of the force to a drive of the lifting column to the at least one carrier element, wherein the damping unit is disposed at least partially between the at least one carrier element and the rod-shaped component.

4. The lifting column according to claim 3, wherein the damping unit includes at least one elastomer and/or rubber and/or at least one oil damper and/or at least one coil spring and/or at least one plate spring and/or at least one gas spring.

5. The lifting column according to claim 3, wherein the at least one resilient member comprises a plurality of plate springs.

6. The lifting column according to claim 1, wherein the damping unit includes at least one support that is fixed relative to a motor of the lifting column during lifting column operation.

7. The lifting column according to claim 1, wherein the damping unit includes at least one part that is fixed relative to an underside of the lifting column during lifting column operation.

8. The lifting column according to claim 1, wherein the damping unit includes at least one elastomer and/or rubber and/or at least one oil damper and/or at least one coil spring and/or at least one element spring and/or at least one gas spring.

9. The lifting column according to claim 1, wherein at least one part of the damping unit is sleeve-shaped.

10. The lifting column according to claim 1, wherein the at least one second column element comprises a second column element and a third column element and wherein the third column element is moveable relative to the second column element.

11. The lifting column according to claim 1, wherein the at least one resilient member comprises a plurality of plate springs.

12. A lifting column comprising:

a first column element; and at least one second column element, the at least one second column element being movable relative to the first column element, and at least one damping unit, the damping unit being deformable by a force that acts on an upper side of the lifting column in at least one operating configuration of the lifting column;

at least one carrier element at a top end of the second column element, wherein the at least one second column element is at least partially received inside the first column element, and wherein the at least one damping unit is located between the at least one carrier element and a drive shaft of a drive of the lifting column.

13. A lifting column comprising:

a first column element; and at least one second column element, the at least one second column element being at least partially received inside the first column element, a drive including a shaft configured to move the at least one second column element relative to the first column element, a carrier plate at a top end of the second column element, and at least one resilient member mounted between the drive and the carrier plate, the resilient member being deformable by a force that acts on the support plate such that the force is at least partly transmitted through the resilient member to the drive.

14. The lifting column according to claim 13, wherein the resilient member is mounted between the carrier plate and the shaft such that the force is at least partially absorbed by the resilient member before reaching the drive.

15. The lifting column according to claim 13, wherein the resilient member is mounted between the shaft and the drive such that the force is at least partially absorbed by the resilient member before reaching the drive.

16. The lifting column according to claim 15, wherein the at least one resilient member comprises a plurality of plate springs.

17. The lifting column according to claim 13, wherein the at least one resilient member comprises a plurality of plate springs.

18. The lifting column according to claim 13, wherein the at least one resilient member comprises an one elastomer or rubber or an oil damper or a coil spring or a plate spring or a gas spring.

* * * * *